US009725260B2

(12) United States Patent
Furusawa

(10) Patent No.: US 9,725,260 B2
(45) Date of Patent: Aug. 8, 2017

(54) SHEET FEEDING APPARATUS AND IMAGE FORMING APPARATUS

(71) Applicant: CANON KABUSHIKI KAISHA, Tokyo (JP)

(72) Inventor: Motohiro Furusawa, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/921,354

(22) Filed: Oct. 23, 2015

(65) Prior Publication Data

US 2016/0122140 A1 May 5, 2016

(30) Foreign Application Priority Data

Oct. 29, 2014 (JP) ..... 2014-219967

(51) Int. Cl.
*B65H 1/04* (2006.01)
*B65H 1/12* (2006.01)
*B65H 3/06* (2006.01)

(52) U.S. Cl.
CPC ..... *B65H 1/04* (2013.01); *B65H 1/12* (2013.01); *B65H 3/0607* (2013.01); *B65H 3/0669* (2013.01); *B65H 2403/512* (2013.01); *B65H 2403/5331* (2013.01); *B65H 2405/324* (2013.01); *B65H 2407/21* (2013.01); *B65H 2801/06* (2013.01)

(58) Field of Classification Search
CPC ..... B65H 2403/5331; B65H 2407/21; B65H 2405/324; B65H 1/12; B65H 3/0607; B65H 3/0669
See application file for complete search history.

(56) References Cited

U.S. PATENT DOCUMENTS 7,055,818 B2 6/2006 Furusawa
7,356,302 B2 * 4/2008 Yamamoto ..... B65H 1/00 271/145
7,553,099 B2 * 6/2009 Bandou ..... B41J 13/103 271/145
7,677,556 B2 * 3/2010 Murayama ..... B65H 1/04 271/117
7,748,691 B2 * 7/2010 Mizuguchi ..... B65H 1/04 271/162
7,866,655 B2 * 1/2011 Uehara ..... G03G 15/6511 271/9.09

(Continued)

FOREIGN PATENT DOCUMENTS

JP 2005-255316 A 9/2005
JP 2012-159770 A 8/2012

*Primary Examiner* — Patrick Cicchino
(74) *Attorney, Agent, or Firm* — Fitzpatrick, Cella, Harper & Scinto

(57) ABSTRACT

A sheet stacking portion for stacking sheets is provided on a cover openably/closably supported on an apparatus body. The sheet stacking portion is guided between a first position and a second position along the cover by a guide portion. A sheet staked on the sheet stacking portion at the first position is fed via a sheet feeding portion. The sheet stacking portion is moved in conjunction with a cover closing action from the first position to the second position not interfering with the sheet feeding portion via a moving portion. A first end side of the moving portion is turnably supported on the apparatus body and a second end side is connected to the sheet stacking portion.

10 Claims, 13 Drawing Sheets

(56) References Cited

U.S. PATENT DOCUMENTS

| | | | | |
|---|---|---|---|---|
| 8,118,301 | B2 * | 2/2012 | Fujii | B41J 13/106 271/207 |
| 8,439,358 | B2 | 5/2013 | Watanabe et al. | |
| 8,506,191 | B2 * | 8/2013 | Yamamoto | B65H 3/44 400/691 |
| 8,682,240 | B2 | 3/2014 | Fukita et al. | |
| 8,740,215 | B2 | 6/2014 | Watanabe et al. | |
| 8,807,559 | B2 | 8/2014 | Osada et al. | |
| 8,857,808 | B2 * | 10/2014 | Matsumoto | B65H 1/04 271/127 |
| 9,102,483 | B2 | 8/2015 | Osada et al. | |
| 9,284,137 | B2 * | 3/2016 | Sato | B65H 1/04 |
| 9,365,372 | B2 * | 6/2016 | Woo | B65H 3/0607 |
| 9,409,734 | B2 * | 8/2016 | Tahara | B65H 3/44 |
| 2006/0182485 | A1 * | 8/2006 | Ogawa | B41J 13/103 400/647 |
| 2007/0063423 | A1 * | 3/2007 | Kirby | B65H 1/12 271/126 |
| 2014/0151954 | A1 | 6/2014 | Furusawa et al. | |
| 2014/0197591 | A1 | 7/2014 | Inoue et al. | |

* cited by examiner

SHEET FEEDING APPARATUS AND IMAGE FORMING APPARATUS

BACKGROUND OF THE INVENTION

Field of the Invention

The present invention relates to a sheet feeding apparatus for feeding sheets, and an image forming apparatus equipped with the same.

Description of the Related Art

In the prior art, there are some image forming apparatuses such as printers and copying machines equipped with a manual sheet-feeding apparatus for conveying irregular sized sheets or special material sheets, in addition to a sheet feeding apparatus for feeding regular sized sheets stored in a sheet feed cassette. According to such manual sheet feeding apparatus, for example, a sheet is stacked on a manual sheet-feeding tray disposed so that it can be opened and closed on a side surface of an image forming apparatus body, and the sheet is fed via a feeding roller.

When feeding a sheet through the manual sheet feeding apparatus, an user opens a cover having the manual sheet-feeding tray disposed on an inner surface and release the manual sheet-feeding tray stored in the image forming apparatus body (hereinafter referred to as apparatus body). When the manual sheet feeding apparatus is not used, the cover is closed, and the manual sheet-feeding tray is stored in the apparatus body. If the feed roller is arranged near the manual sheet-feeding tray with the aim to downsize the image forming apparatus, there is a possibility that the manual sheet-feeding tray and the feed roller may interfere with one another when storing the manual sheet-feeding tray.

Therefore, Japanese Patent Application Laid-Open Publication No. 2005-255316 provides a configuration where a link arm is provided between an apparatus body and a manual sheet-feeding tray. The manual sheet-feeding tray is moved above a feed roller via the link arm when the manual sheet-feeding tray is closed, so as to prevent increase in size of the image forming apparatus.

Recently, there are demands for an image forming apparatus that can be downsized without having the apparatus body and the manual sheet-feeding tray connected via a link arm.

SUMMARY OF THE INVENTION

According to one aspect of the present invention, there is provided a sheet feeding apparatus including an apparatus body, a cover openably/closably supported on the apparatus body a sheet stacking portion disposed on an apparatus body-side of the cover and stacking sheets, a guide portion guiding the sheet stacking portion along the cover between a first position and a second position, a sheet feeding portion disposed on the apparatus body and feeding sheets stacked on the sheet stacking portion at the first position, and a moving portion moving the sheet stacking portion, in conjunction with a closing operation of the cover, from the first position to the second position where the sheet stacking portion does not interfere with the sheet feeding portion.

Further features of the present invention will become apparent from the following description of exemplary embodiments with reference to the attached drawings.

DESCRIPTION OF THE EMBODIMENTS

Figure 1:
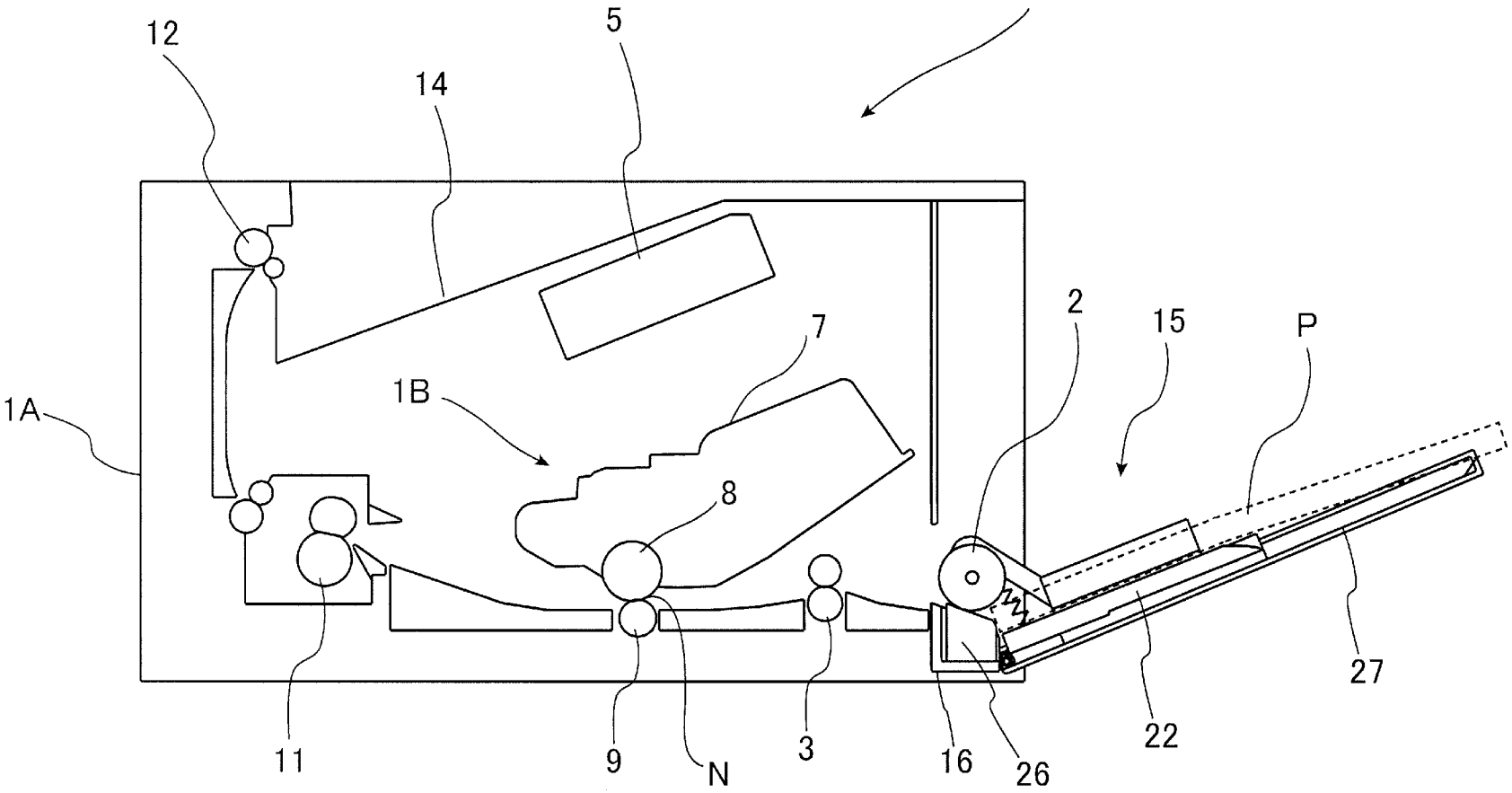
FIG. 1 is an overall schematic view showing a laser beam printer having a manual sheet-feeding apparatus according to a first embodiment.

Now, the embodiments for carrying out the present invention will be described in detail with reference to the drawings. FIG. 1 is a view illustrating a schematic configuration of a laser beam printer as an image forming apparatus according to a first embodiment of the present invention. In FIG. 1, a laser beam printer 1 has a laser beam printer body (hereinafter referred to as printer body) 1A. The printer body 1A is equipped with an image forming portion 1B for forming an image on a sheet, a manual sheet-feeding apparatus 15 as a sheet feeding apparatus for feeding a sheet to the image forming portion 1B manually, and so on.

The image forming portion 1B is equipped with a process cartridge 7 including a photosensitive drum 8 and a process unit (charging unit, developing section and cleaning section) acting on the drum, formed integrally and attached in a detachable manner to the printer body 1A, and a transfer roller 9, and so on. Further, the manual sheet-feeding apparatus 15 is equipped with a manual sheet-feeding tray 22 as sheet stacking portion, and a feed roller 2 as sheet feeding portion for feeding a sheet P stacked in the manual sheet-feeding tray 22.

Next, we will describe an image forming operation of the laser beam printer 1 having the above-described configuration. When an image information is transmitted from a personal computer and the like not shown, and a control unit not shown having carried out an image forming process to the image information outputs a print command, sheets P stacked in the manual sheet-feeding tray 22 is fed one at a time via the feed roller 2 of the manual sheet-feeding apparatus 15. Then, the sheet P fed from the manual sheet-feeding apparatus 15 is separated into single sheet via a separation unit composed of the feed roller 2 and a separating pad 26 and conveyed to a conveyance roller 3, and thereafter, further conveyed to a transfer nip N composed of the photosensitive drum 8 and the transfer roller 9.

On the other hand, based on the print command and the image information, a laser beam based on the image information is irradiated on the photosensitive drum 8 from a laser scanner unit 5, and a latent image is formed on the surface of the photosensitive drum 8. Further, by developing the latent image, a toner image is formed on the photosensitive drum 8.

The toner image on the photosensitive drum 8 is transferred to the sheet P conveyed by the transfer nip N. The sheet P to which the toner image has been transferred is sent to a fixing device 11, where the toner image is fixed semi-permanently to the sheet by heating and pressing via the fixing device 11. Thereafter, the sheet P is sent to a discharge roller pair 12 and discharged onto a discharged sheet stacking plate 14. The sheet fed to the laser beam printer 1 on which an image is formed is not restricted to regular paper, and it can be a postcard, a label paper, an OHP sheet, and so on.

Figure 2:
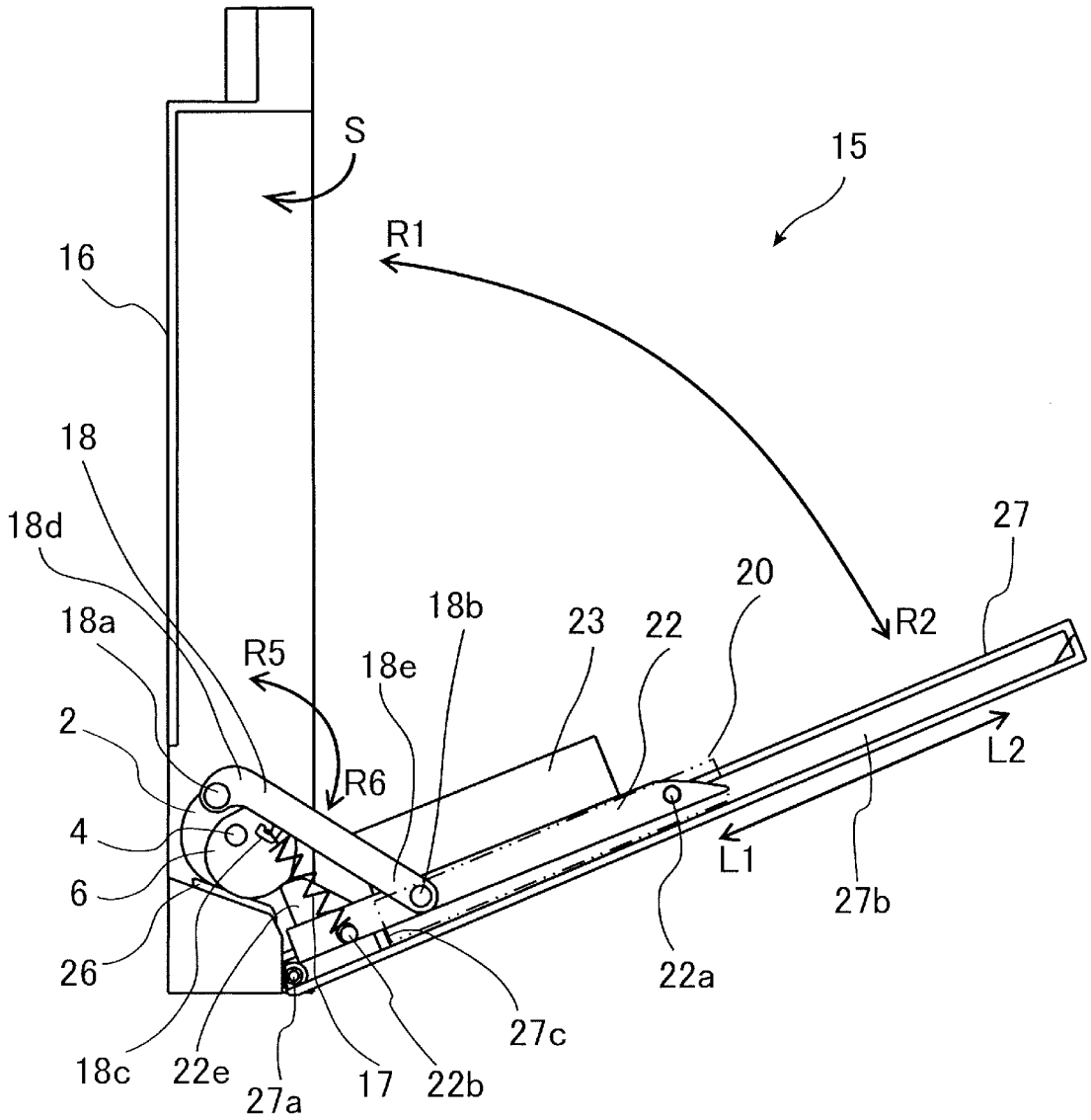
FIG. 2 is a side view showing the manual sheet-feeding apparatus.
Figure 3A:
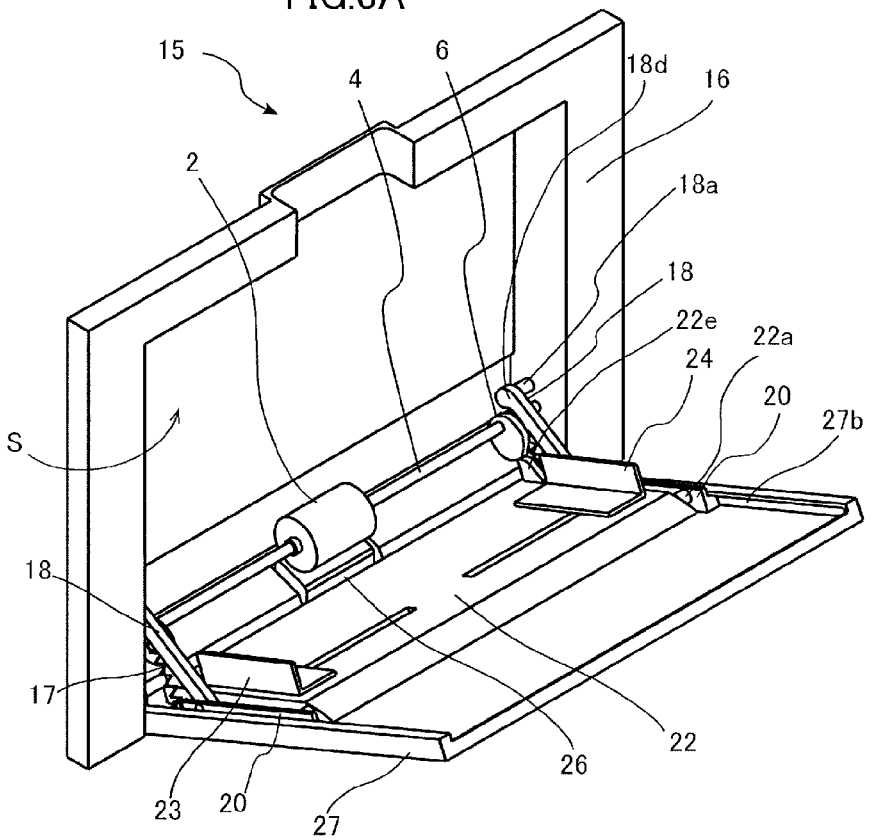
FIG. 3A is a perspective view showing the manual sheet-feeding apparatus.
Figure 3B:
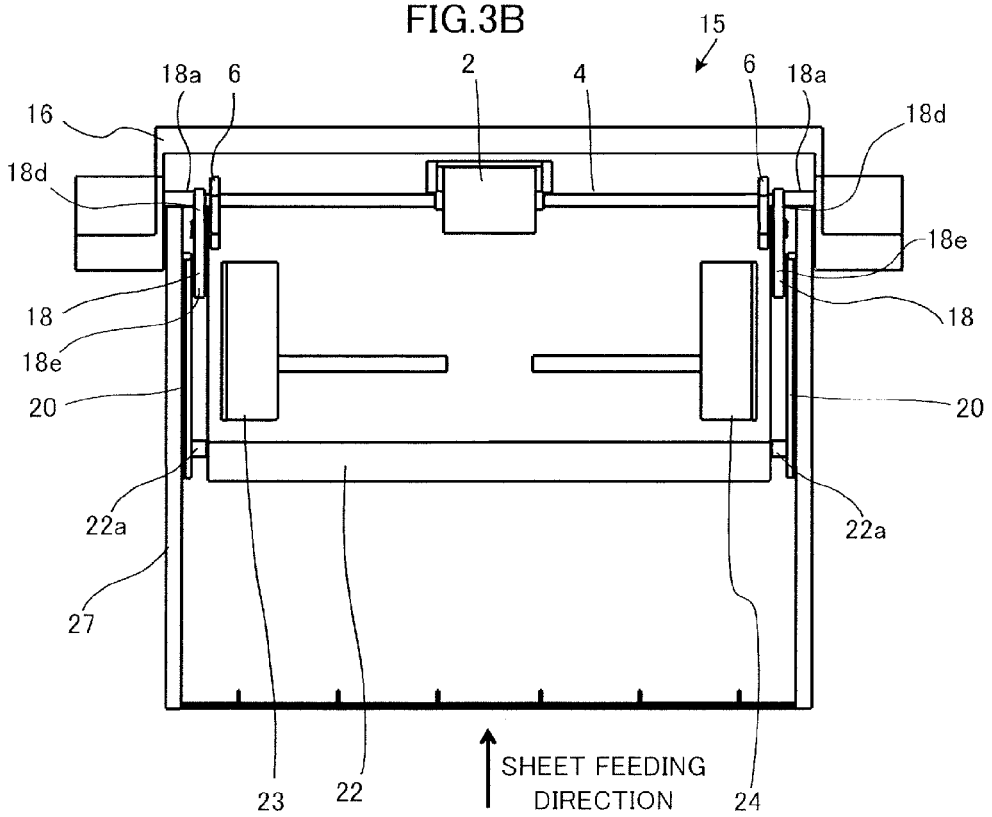
FIG. 3B is a plan view showing the manual sheet-feeding apparatus.

As shown in FIGS. 2 through 3B, the manual sheet-feeding apparatus 15 is disposed on a side surface of the printer body 1A, and has an openable/closable manual feed cover 27 (cover) forming an exterior of the printer body 1A. This manual feed cover 27 is turnably supported around a shaft 27*a* as fulcrum disposed on a lower end portion of the cover to directions of arrows R1 and R2 with respect to a manual feed frame forming an apparatus body of the manual sheet-feeding apparatus 15.

A manual sheet-feeding tray 22 as sheet stacking portion is turnably attached in the vertical direction around a shaft 22*a* as fulcrum, and also slidably in directions of arrows L1 and L2, on an inner wall surface on the side of the manual feed frame 16 of the manual feed cover 27. The manual feed cover 27 is retained in an opened state as shown in FIG. 2 by a pair of arm members 18 (moving portion) for moving the manual sheet-feeding tray 22 to a first position and a second position, as described later.

Cams 6 are attached to a roller shaft 4 (rotation shaft) on which the feed roller 2 is mounted. Contact portions 22*e* capable of being in contact with the cams 6 are disposed on a turning end (moving end) side of the manual sheet-feeding tray 22. Pressurizing springs 17 (biasing members) composed of tension springs are mounted between spring hook portions 22*b* disposed on the manual sheet-feeding tray 22 and spring hook portions 18*c* disposed on the arm members 18. The sheet on the manual sheet-feeding tray 22 contacts the feed roller 2 via a given sheet feeding pressure for feeding sheets by an elastic force provided by the pressurizing springs 17.

The contact portion 22*e* is pressed against the cam 6 by the pressurizing springs 17. Before the sheet feeding operation is started, the manual sheet-feeding tray 22 is pressed downward via the contact portion 22*e* by the cam 6 resisting against the pressurizing spring 17, and thereby, the manual sheet-feeding tray 22 is maintained in a separated state from the feed roller 2. Thus, by having the manual sheet-feeding tray 22 separated from the feed roller 2 during standby, the supplementation or replacement of sheets can be performed easily.

As shown in FIG. 3A, a pair of grooves 27*b* are formed opposing one another on inner side wall surfaces of the manual feed cover 27. A pair of slide arms 20 as sliding members are retained movably in directions of arrows L1 and L2 on the pair of grooves 27*b*, and the pair of slide arms 20 support the shaft 22*a* (turning fulcrum) of the manual sheet-feeding tray 22 in a rotatable manner. In other words, the manual sheet-feeding tray 22 is supported rotatably and slidably via the slide arms 20 on the manual feed cover 27. The slide arms 20 (guide portions) guide the manual sheet-feeding tray 22 to a first position (position shown in FIG. 2) and a second position (position shown in FIG. 5) in directions of arrows L1 and L2 along the manual feed cover 27. By the slide arms 20 abutting against abutment members 27*c* (positioning portions) disposed on the manual feed cover 27, the movement of the arms toward the direction of arrow L1 is restricted, and thereby, the manual sheet-feeding tray 22 is positioned to the first position.

On one end side 18*d* (first end side) of the pair of arm members 18 is provided a shaft 18*a* projected in a direction of width orthogonal to the direction in which the sheets are fed, as shown in FIGS. 2 to 3B, and on the other end side 18*e* (second end side) thereof is provided a shaft 18*b* projected in the width direction. The arm members 18 are turnably supported via the shafts 18*a* in directions of arrows R5 and R6 with respect to a storage portion S formed on the manual feed frame 16. Further, the shaft 18*b* (joint portion) of each arm member 18 is supported rotatably on the slide arm 20. The shaft 18*b* of the arm member 18 is mounted on the slide arm 20 at a position closer to the feed roller 2 than the shaft 22*a* of the manual sheet-feeding tray 22. In other words, the shaft 22*a* is positioned more distant from the feed roller 2 than the shaft 18*b*.

Side regulating plates 23 and 24 as regulating members for regulating the position of the sheet in the width direction are supported movably in the width direction on both width-direction ends of the manual sheet-feeding tray 22. A rack portion not shown extending in the width direction is disposed on the bottom portion of the side regulating plates 23 and 24, and pinions not shown that engage with respective racks of the side regulating plates 23 and 24 are provided on a rear surface of the side on which the sheets are stacked in the manual sheet-feeding tray 22. When a user moves the side regulating plate 23 disposed on one side, the side regulating plate 24 disposed on the opposite side is moved in conjunction with through the rack and pinion mechanism, so that the side regulating plates 23 and 24 either move closer to or away from each other.

Next, we will describe the sheet feeding operation using the manual sheet-feeding apparatus 15 having the above-described configuration. When performing manual sheet feeding operation, at first, the user opens the manual feed cover 27 in direction R2 shown in FIG. 2. When the manual feed cover 27 is opened, the slide arms 20 are drawn toward the direction of arrow L1 along the grooves 27*b* accompanying the rotation of the arm members 18 in the direction of arrow R6, since the shafts 18*b* of the arm members 18 are connected to the slide arms 20. The structure adopts a four-joint link where the slide arms 20 moving in sliding motion connect the arm members 18 rotating around the shaft 18*d* and the manual feed cover 27 rotating around the shaft 27*a* (turning shaft). When the slide arms 20 move in this manner, the manual sheet-feeding tray 22 is moved toward the direction of L1 in conjunction with the slide arms 20, since the shaft 22*a* of the manual sheet-feeding tray 22 is supported on the slide arms 20.

When the slide arms 20 move in the direction of L1 for a given amount, the arms are abutted against the abutment members 27*c*, by which the movement of the slide arms 20 is regulated. As a result, the manual sheet-feeding tray 22 is retained at the first position when the turning end (side opposite from the shaft 22*a*) reaches an area beneath the feed roller 2.

Further, when the manual sheet-feeding tray 22 is in a state retained at the first position, the contact portion 22*e* is pressed by the cam 6 and the manual sheet-feeding tray 22 is in a state separated from the feed roller 2. Therefore, it becomes possible to set sheets on the manual sheet-feeding tray 22 and enable sheets to be fed to the device. In the present embodiment, abutment members 27*c* being in contact with the slide arms 20 are provided to the manual feed cover 27 to retain the manual sheet-feeding tray 22 at the first position when the manual feed cover 27 is opened, but other configurations can also be adopted. For example, a configuration can be adopted where abutment portions for positioning the manual sheet-feeding tray 22 at the first position are provided between the arm members 18 and the manual feed cover 27, between the manual feed cover 27 and the manual feed frame 16, or between the arm members 18 and the manual feed frame 16.

Figure 4:
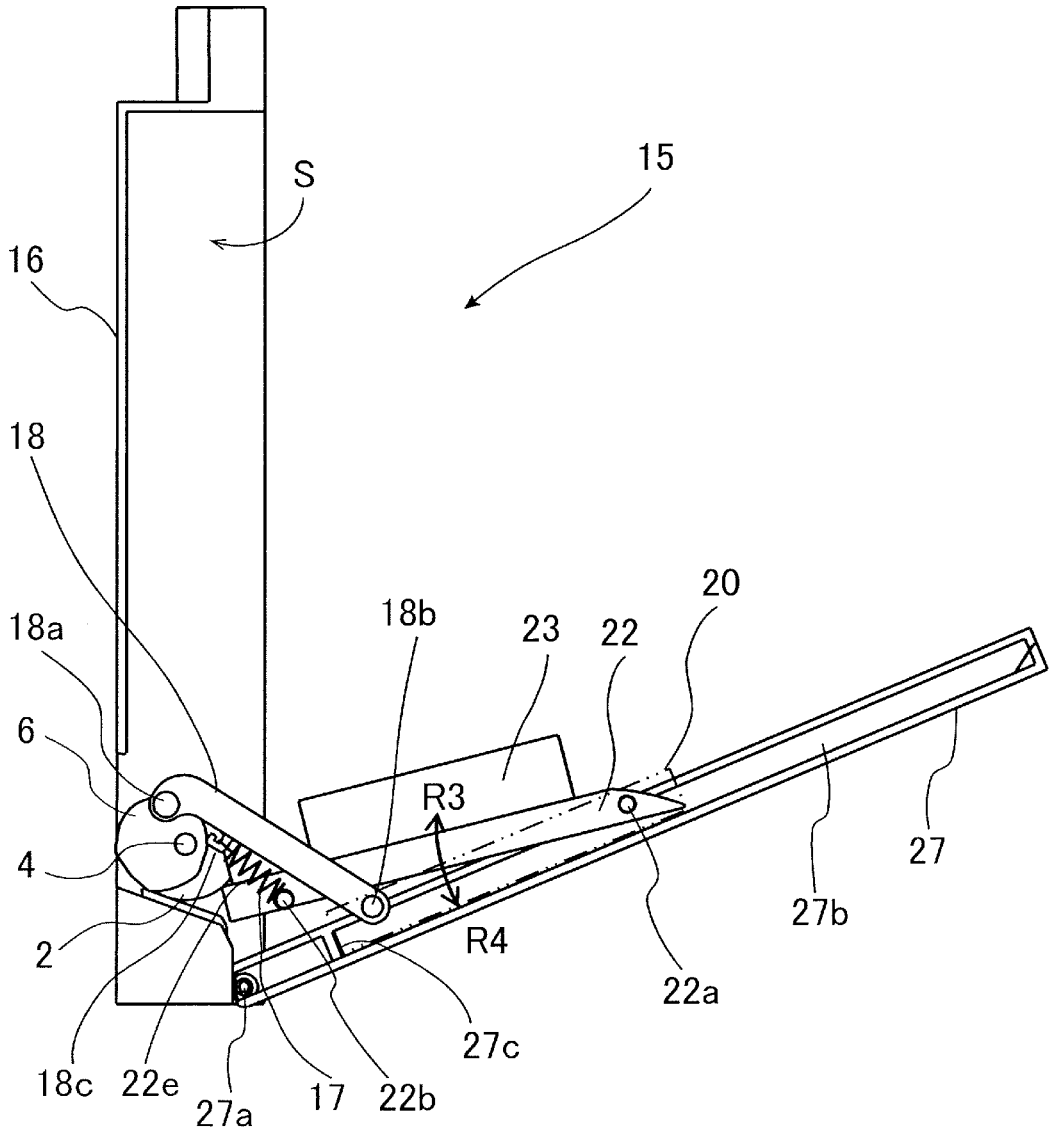
FIG. 4 is a side view showing the manual sheet-feeding apparatus in a state where a sheet is fed.

Thereafter, when the sheet feeding operation is started and the feed roller 2 is driven to rotate in a clockwise direction, the cam 6 having been pressing down the contact portion 22*e* of the manual sheet-feeding tray 22 is rotated and separated from the contact portion 22*e* of the manual sheet-feeding tray 22. Thereby, as shown in FIG. 4, the biasing force of the pressurizing spring 17 rotates the manual sheet-feeding tray 22 upward with the shaft 22*a* acting as fulcrum, and the uppermost sheet stacked in the manual sheet-feeding tray 22 is pressed against the feed roller 2. Thereafter, when the feed roller 2 is rotated, the uppermost sheet is guided to the separating pad 36 pressed against the feed roller 2, and separated into single sheets. Thereby, overfeeding of sheets can be prevented, and the sheets can be sent downstream one at a time.

When the sheet feeding operation is completed, the user closes the manual feed cover 27, and stores the manual sheet-feeding tray 22 in the storage portion S formed in the manual feed frame 16. The feed roller 2 is disposed at the lower section of the storage portion S. When storing the manual sheet-feeding tray 22, the user rotates the manual feed cover 27 in the direction of R1 shown in FIG. 2. At this time, since the slide arms 20 and the shafts 18*b* of the arm members 18 are connected, the slide arms 20 are pressed toward the direction of arrow L2 along the grooves 27*b* accompanying the rotation of the arm members 18 in the direction of arrow R5. When the slide arms 20 move in the direction of arrow L2, the manual sheet-feeding tray 22 is also moved in the direction of L2 in conjunction with the slide arms 20.

Figure 5:
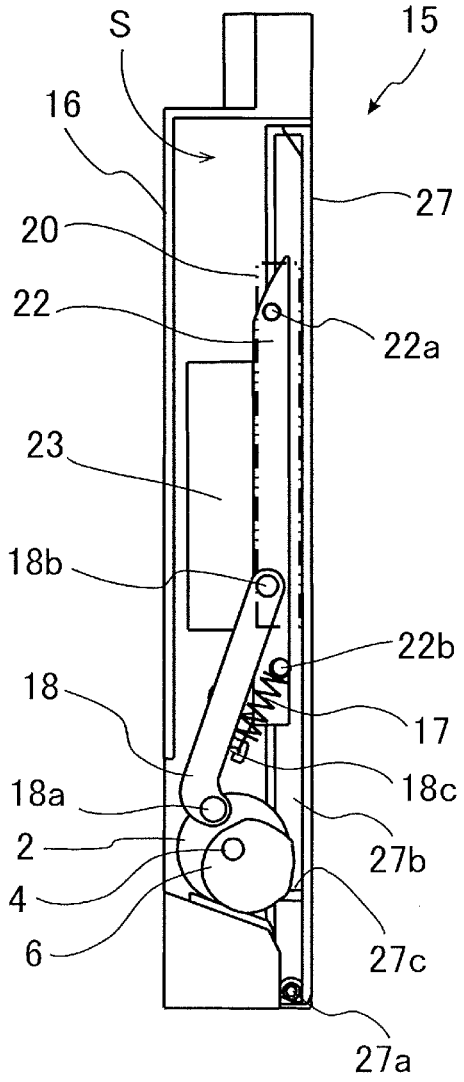
FIG. 5 is a side view of the manual sheet-feeding apparatus in a state where a manual sheet-feeding tray is stored.

Here, the arm members 18 are designed to have a length so that the manual sheet-feeding tray 22 is stored above the feed roller 2 when the manual feed cover 27 is closed, as shown in FIG. 5. At this time, the manual sheet-feeding tray 22 is positioned at a second position farthest from the first position. Since the arm members 18 have such length, the manual sheet-feeding tray 22 can be stored without interfering with the feed roller 2 when closing the manual feed cover 27. In the state where the manual feed cover 27 is closed, the manual feed cover 27 is overlapped with the feed roller 2 when viewed from the axial direction of the roller shaft 4. Thus, it becomes possible to realize downsizing of the laser beam printer 1.

In the present embodiment, as described, the manual sheet-feeding tray 22 is disposed rotatably and slidably to the manual feed cover 27 via the slide arms 20, and at the same time, the shafts 18*b* of the arm members 18 are attached rotatably to the feed roller 2-side of the slide arms 20. When storing the manual sheet-feeding tray 22 in the storage portion S, the manual sheet-feeding tray 22 is moved to the second position above the feed roller 2 by the arm members 18 pushing up the slide arms 20.

Further, when the manual feed cover 27 is opened and the manual sheet-feeding tray 22 is moved to the first position, the other end side 18*e* of the arm members 18 is moved to a position close to the feed roller 2. Thereby, the side regulating plates 23 and 24 can be manipulated without being interrupted by the arm members 18.

In the present embodiment, the height of the upper surface of the slide arms 20 is set to a position either equivalent to or lower than the upper surface of the manual sheet-feeding tray 22 so that it will not project from the upper surface of the manual sheet-feeding tray 22 at least when the manual sheet-feeding tray 22 is at a first position. Thereby, it becomes possible to prevent components from being arranged in a space surrounding the side regulating plates 23 and 24, and to ensure enough space to allow the hand of a user to enter when manipulating the side regulating plates 23 and 24 without increasing the size of the printer body 1A.

As described, according to the present embodiment, the slide arms 20 that move in conjunction with the rotation of the arm members 18 are made to support the manual sheet-feeding tray 22. Then, when storing the manual sheet-feeding tray 22 in the storage portion S, by having the slide arms 20 slide in conjunction with the rotation of the arm members 18, the manual sheet-feeding tray 22 is made to move to a storage position (second position) above the feed roller 2 within the storage portion S.

Thereby, the printer body 1A can be prevented from being increased in size. Further, when using the manual sheet-feeding apparatus 15, the arm members 18 can be disposed close to the feed roller 2, so that the operability of the side regulating plates 23 and 24 can be improved. In other words, according to the present embodiment, it becomes possible to realize both good operability of the side regulating plates 23 and 24 and downsizing of the laser beam printer 1.

Figure 6:
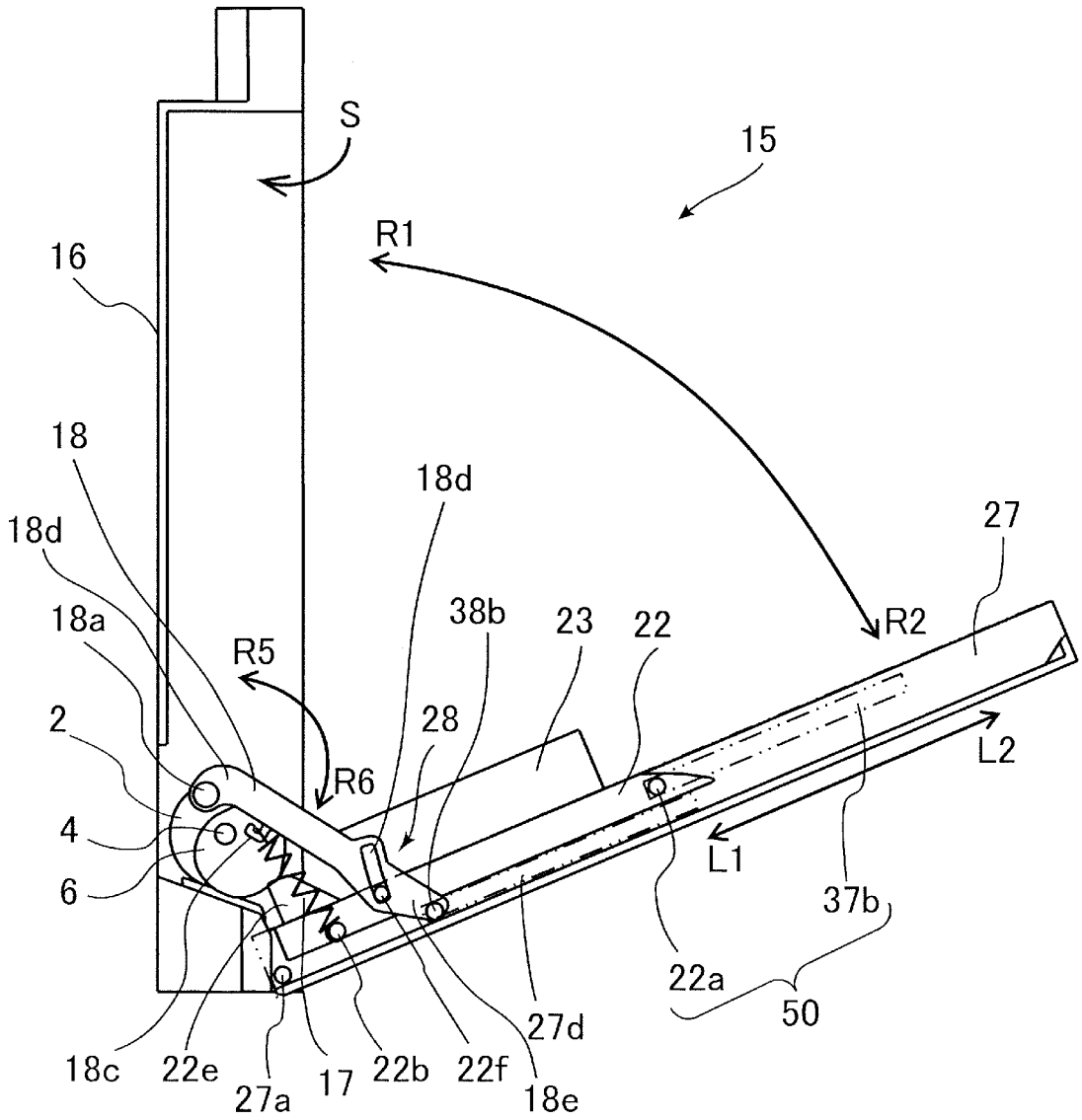
FIG. 6 is a side view showing a manual sheet-feeding apparatus according to a second embodiment.
Figure 7A:
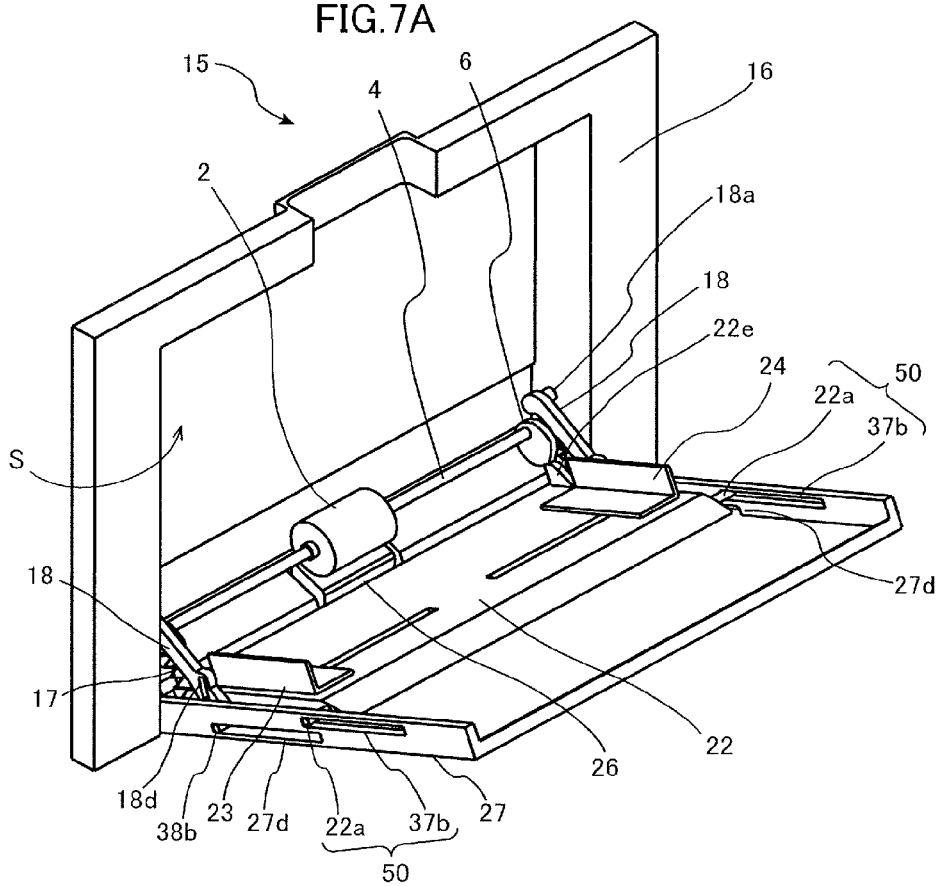
FIG. 7A is a perspective view showing the manual sheet-feeding apparatus.
Figure 7B:
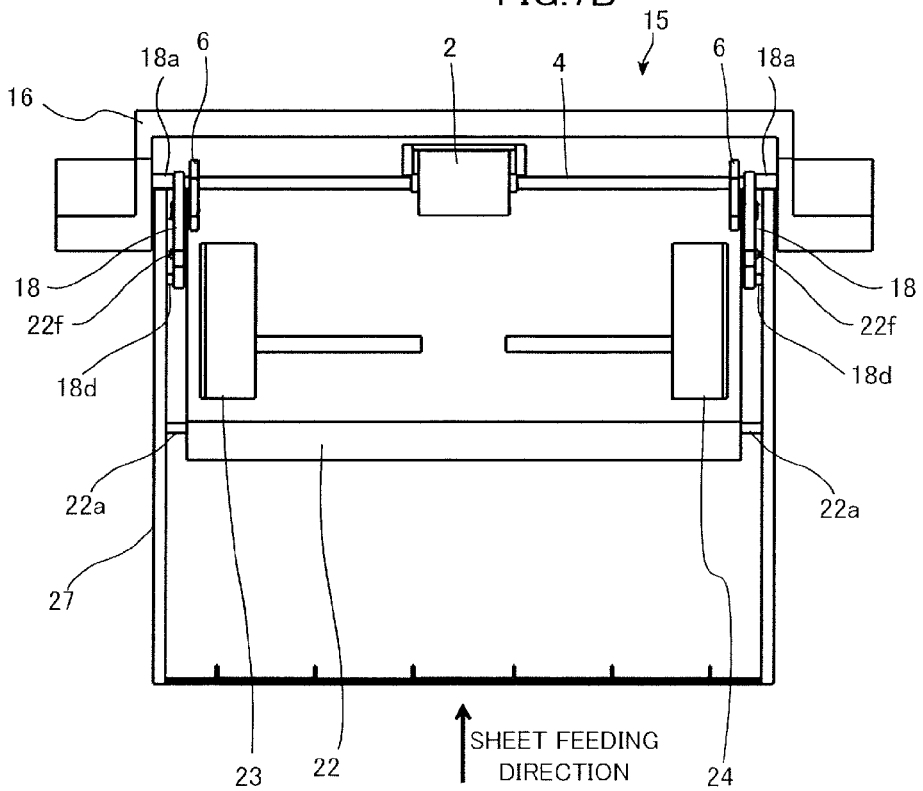
FIG. 7B is a plan view showing the manual sheet-feeding apparatus.

Next, a second embodiment of the present invention will be described. FIGS. 6, 7A and 7B are drawings illustrating a configuration of a sheet feeding apparatus according to the present embodiment. In FIGS. 6 and 7, the same reference numbers as FIGS. 2, 3A and 3B described earlier show the same or corresponding portions, so that detailed descriptions are omitted.

As shown in FIGS. 6 through 7B, groove sections 37*b* (engaged portion) and other groove sections 27*d* are formed on the manual feed cover 27. Then, shafts 22*a* (projection) of the manual sheet-feeding tray 22 are engaged rotatably and slidably to the groove sections 37*b* of the manual feed cover 27. The groove sections 37*b* are formed along side surfaces of the manual feed cover 27, and the shafts 22*a* are formed to project toward a width direction from the side surfaces of the manual sheet-feeding tray 22. Shafts 38*b* (protrusion) disposed on the other end side 18*e* of the arm members 18 (moving portion) are engaged rotatably and slidably to the other groove sections 27*d* of the manual feed cover 27.

In the present embodiment, a slit 18*d* is formed between the shafts 18*a* and 18*d* of each arm member 18, and a shaft (pin) 22*f* is formed on a side wall of the manual sheet-feeding tray 22. The shaft 22*f* is engaged with the slit 18*d* of the arm member 18, and formed at a position closer to the feed roller 2 than the shaft 22*a*.

Further, the slit 18*d* of the arm member 18 is formed in an arc shape having its center of rotation set at the shaft 22*a* of the manual sheet-feeding tray 22, which differs from the arc shape having its center set at the shaft 18*a* being the center of rotation of the arm member 18. Thus, when the arm members 18 are rotated, the manual sheet-feeding tray 22 can be rotated around the shaft 22*a* within a range where the shaft 22*f* and the slit 18*d* are engaged.

Next, we will describe the sheet feeding operation using the manual sheet-feeding apparatus 15 having the above-described configuration. When performing a manual sheet feeding operation, at first, the user opens the manual feed cover 27 in a direction of arrow R2 shown in FIG. 6. When the manual feed cover 27 is opened, the arm members 18 are rotated in the direction of arrow R6 around the shafts 18*a*, since the other groove sections 27*d* of the manual feed cover 27 are engaged with the shafts 38*b* of the arm members 18. Accompanying the rotation of the arm members 18 in the direction of R6, the shafts 38*b* move in the direction of L1 along the other groove sections 27*d* of the manual feed cover 27. The structure adopts a four-joint link where the shafts 38*b* connect the arm members 18 rotating around the shafts 18*d* and the manual feed cover 27 rotating around the shafts 27*a* while moving in sliding motion along the other groove sections 27*d*.

When the arm members 18 are rotated in this manner, the manual sheet-feeding tray 22 is moved in the direction of L1 along the groove section 37*b*, since the shafts 22*f* are engaged with the slits 18*d* of the arm members 18 and the shafts 22*a* are engaged with the groove sections 37*b* of the manual feed cover 27. In other words, in the present embodiment, the groove section 37*b* and the shaft 22*a* constitute a guide portion 50 for guiding the manual sheet-feeding tray 22 between the first position and the second position.

Thereafter, when the manual feed cover 27 and the arm members 18 rotate for a given amount, the shafts 38*b* are abutted against an end portion in the L1 side of the other groove sections 27*d* of the manual feed cover 27 and stopped, by which the rotation of the arm members 18 is regulated. Thereby, when the manual feed cover 27 is opened, the manual sheet-feeding tray 22 is retained at the first position.

Figure 8:
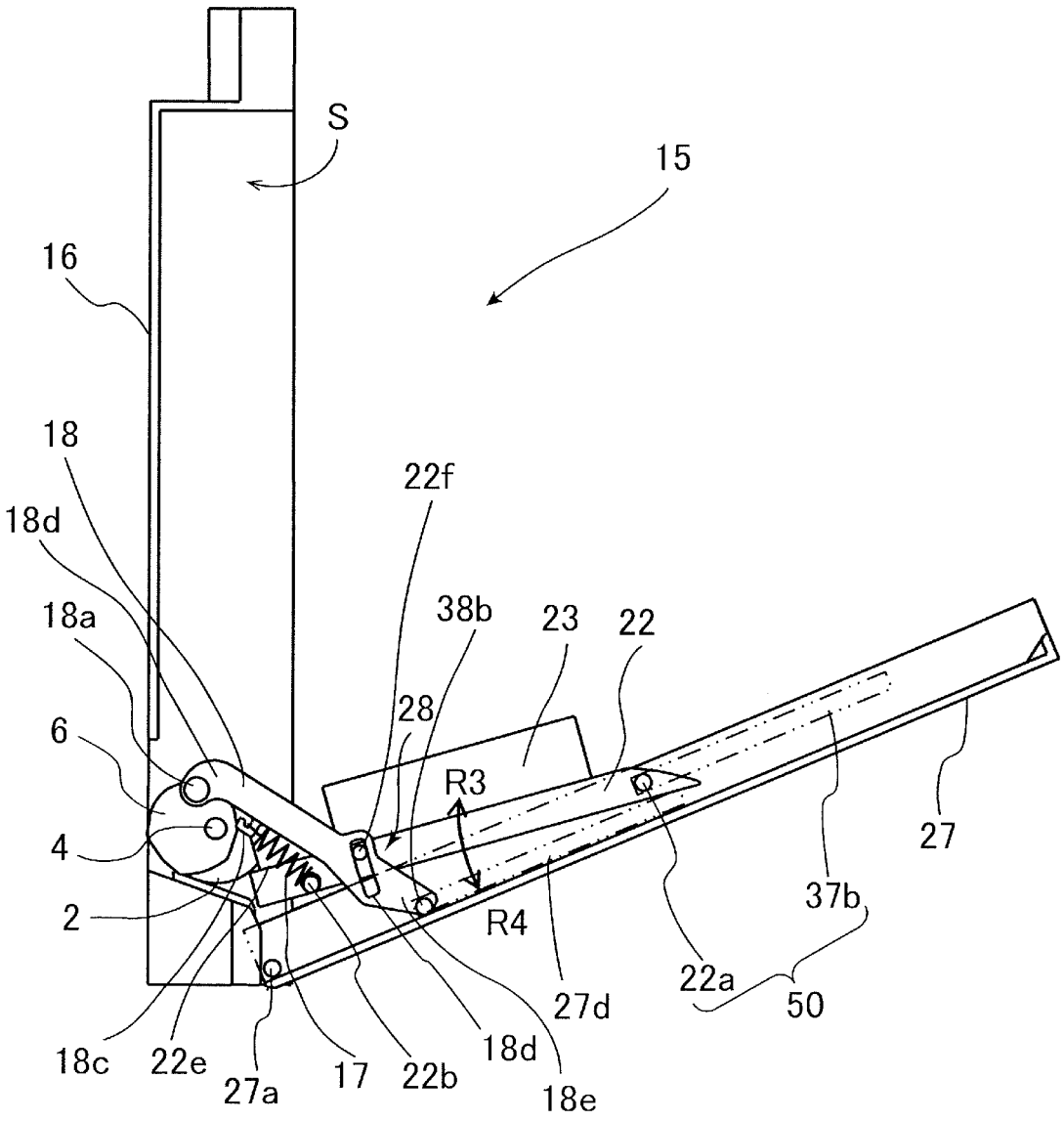
FIG. 8 is a side view showing the manual sheet-feeding apparatus in a state where a sheet is fed.

Thereafter, when the sheet feeding operation is started and the feed roller 2 is rotated, the cam 6 is moved away from the contact portion 22*e* of the manual sheet-feeding tray 22 along with the rotation of the feed roller 2. Thereby, as shown in FIG. 8, the manual sheet-feeding tray 22 is rotated upward around the shaft 22*a* as fulcrum so as to contact the feed roller 2 by the biasing force of the pressurizing spring 17. Then, when the manual sheet-feeding tray 22 is rotated upward, the uppermost sheet stacked in the manual sheet-feeding tray 22 is pressed against the feed roller 2. Thereafter, when the feed roller 2 is rotated, the uppermost sheet is separated one at a time and conveyed downstream.

When the sheet feeding operation is completed, the user closes the manual feed cover 27 and stores the manual sheet-feeding tray 22 in the storage portion S. When storing the manual sheet-feeding tray 22, the user rotates the manual feed cover 27 in the direction of R1 shown in FIG. 6. At this time, since the other groove sections 27*d* of the manual feed cover 27 and the shafts 38*b* of the arm members 18 are mutually engaged, the arm members 18 rotate in the direction of arrow R5 around the shafts 18*a* in conjunction with the manual feed cover 27.

Then, along with this rotation of the arm members 18 in the direction of arrow 5, the shafts 38*b* of the arm members 18 move in the direction of L2 along the other groove section 27*d* of the manual feed cover 27. Then, since the shafts 22*f* of the manual sheet-feeding tray 22 are engaged with the slits 18*d* of the arm members, the shafts 22*a* of the manual sheet-feeding tray 22 are guided by the groove section 37*b* and moved in the direction of L2, along with the movement of the shafts 18*d* in the direction of L2. In other words, when the arm members 18 are rotated in the direction of R5, the manual sheet-feeding tray 22 is moved in the direction of L2.

Figure 9:
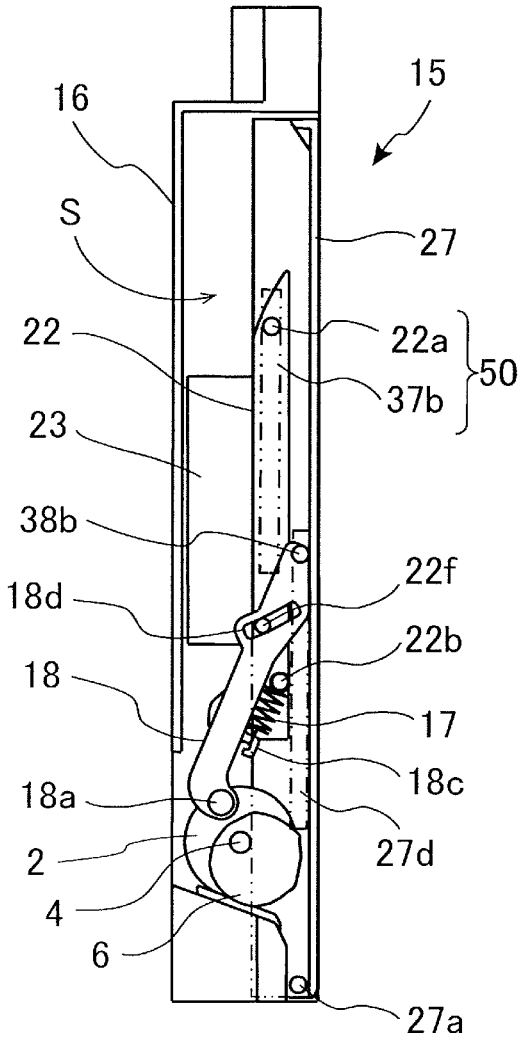
FIG. 9 is a side view showing the manual sheet-feeding apparatus in a state where the manual sheet-feeding tray is stored.

In the present embodiment, the arm members 18 are designed to have a length so that the manual sheet-feeding tray 22 is stored above the feed roller 2 when the manual feed cover 27 is closed, as shown in FIG. 9. At this time, the manual sheet-feeding tray 22 is positioned at a second position farthest from the first position. Since the arm members 18 have such length, the manual sheet-feeding tray 22 can be stored without interfering with the feed roller 2 when closing the manual feed cover 27. In the state where the manual feed cover 27 is closed, the manual feed cover 27 is overlapped with the feed roller 2 when viewed from the axial direction of the roller shaft 4. Thus, it becomes possible to downsize the laser beam printer 1.

When the manual feed cover 27 is opened and the manual sheet-feeding tray 22 is moved to the first position, the other end side 18*e* of the arm members 18 is moved to a position close to the feed roller 2. Thereby, it becomes possible to manipulate the side regulating plates 23 and 24 without being interrupted by the arm members 18. According further to the present embodiment, since the other end sides 18*e* of the arm members 18 are connected directly to the manual sheet-feeding tray 22, the number of components can be reduced and costs can be cut down. Then, by the shafts 38*b* formed on the other end sides 18*e* of the arm members 18 abutting against the other groove sections 27*d*, the manual sheet-feeding tray 22 can be retained stably at the first position while maintaining the manual feed cover 27 in the opened state.

As described, according to the present embodiment, the arm members 18 and the manual sheet-feeding tray 22 are connected by the shafts 22*f* and the slits 18*d*, and the manual sheet-feeding tray 22 is stored in the storage portion S above the feed roller 2 in conjunction with the operation of closing the manual feed cover 27. Thus, it becomes possible to prevent the increase in size of the printer body 1A. Further, when the manual feed cover 27 is opened, the arm members 18 will be arranged near the feed roller 2, and the operability of the side regulating plates 23 and 24 can be improved. As described, according to the present embodiment, it becomes possible to realize both good operability of the side regulating plates 23 and 24 and downsizing of the laser beam printer 1.

Figure 10:
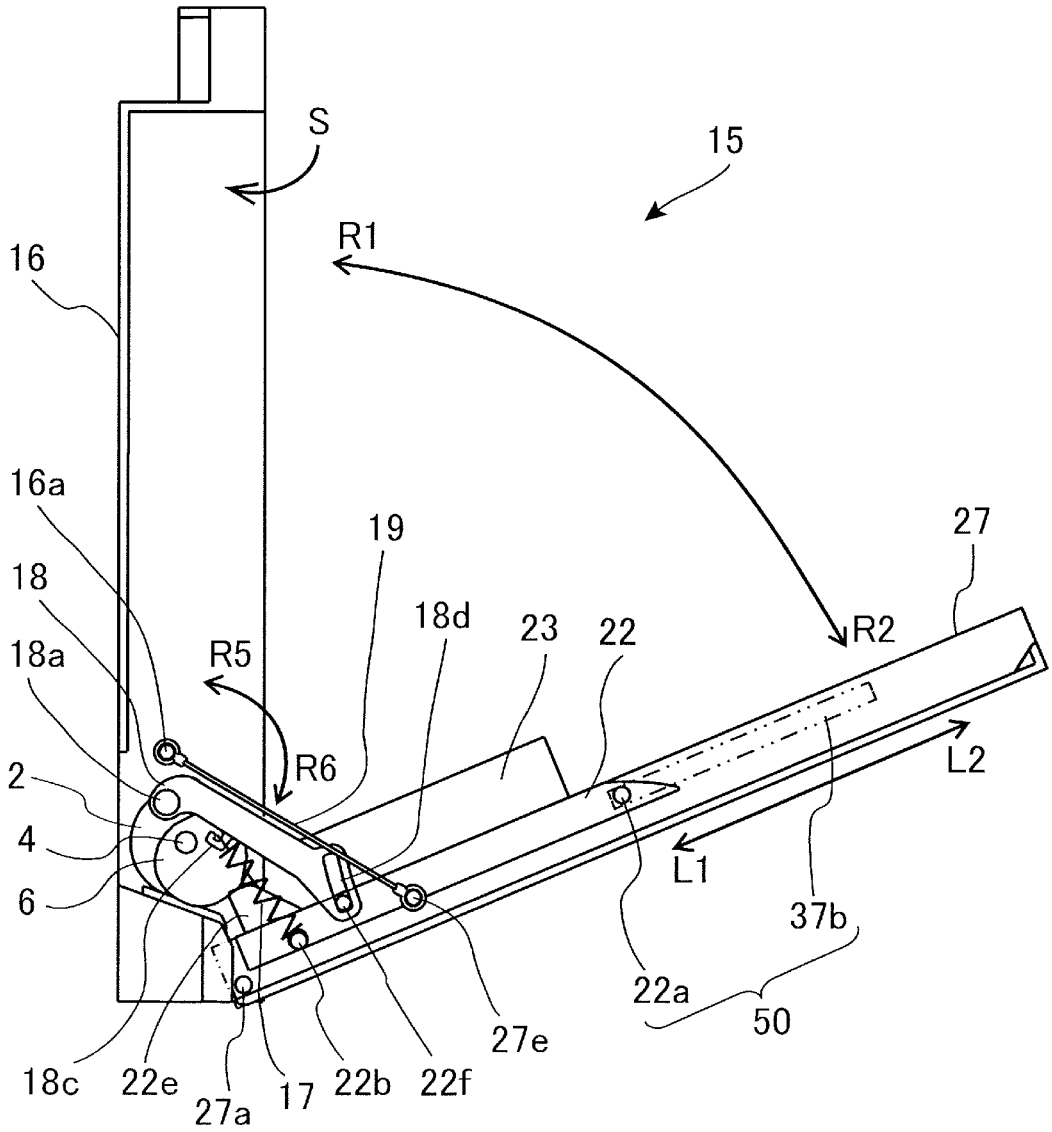
FIG. 10 is a side view showing a manual sheet-feeding apparatus according to a third embodiment.
Figure 11A:
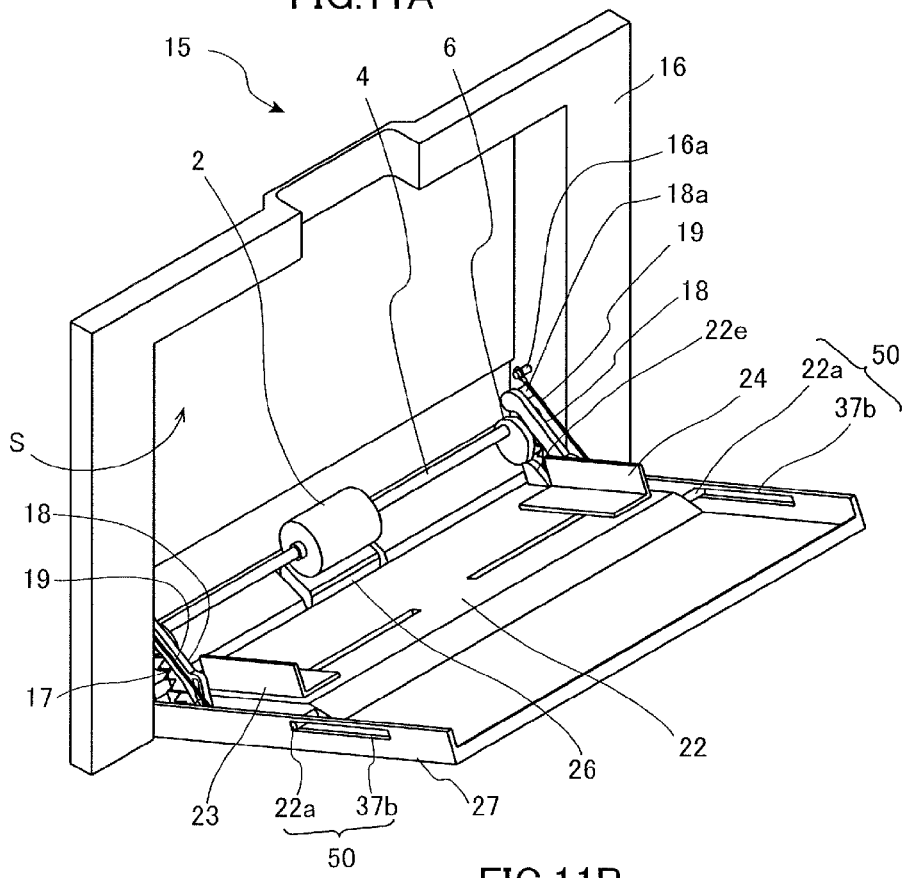
FIG. 11A is a perspective view showing the manual sheet-feeding apparatus.
Figure 11B:
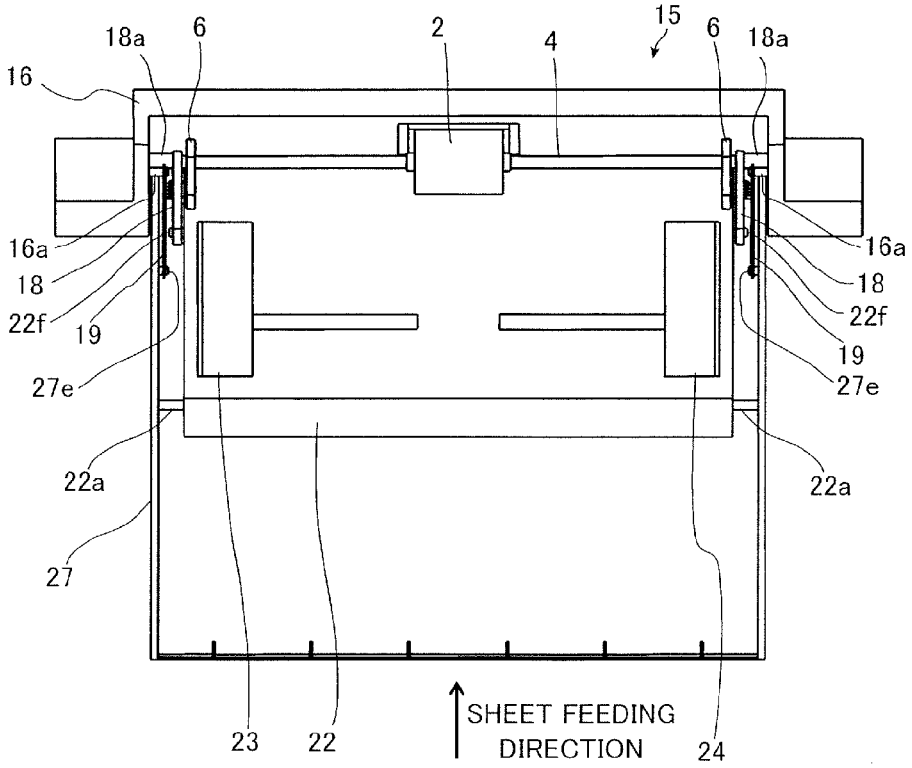
FIG. 11B is a plan view showing the manual sheet-feeding apparatus.

Next, we will describe a third embodiment of the present invention. FIGS. 10, 11A and 11B are drawings illustrating a configuration of a sheet feeding apparatus according to the present embodiment. In FIGS. 10, 11A and 11B, the same reference numbers as those in FIGS. 6 to 7B described earlier denote identical or corresponding portions, so that detailed descriptions thereof are omitted.

As shown in FIGS. 10 through 11B, shafts 27*e* are disposed on the manual feed cover 27 between the shafts 22*a* and the spring hook portions 22*b*. Retention wires 19 (wires) are disposed between shafts 16*a* formed on the manual feed frame 16 and shafts 27*e*. According to the present embodiment, the retention strength when the manual sheet-feeding tray 22 is opened can be improved by providing such retention wires 19. Also according to the present embodiment, similar to the second embodiment described earlier, the shafts 22*a* of the manual sheet-feeding tray 22 are engaged rotatably and slidably with the groove sections 37*b* of the manual feed cover 27.

Next, we will describe the sheet feeding operation using the manual sheet-feeding apparatus 15 having the above-described configuration. When performing manual sheet feeding operation, at first, the user opens the manual feed cover 27 toward the direction of R2 shown in FIG. 10. When the manual feed cover 27 is opened, the arm members 18 are rotated in the direction of arrow R6 around the shafts 18*a*, since the shafts 22*f* of the manual sheet-feeding tray 22 and the slits 18*d* of the arm members 18 are mutually engaged. Further, accompanying the rotation of the arm members 18 in the direction of R6, the manual sheet-feeding tray 22 is moved toward the direction of arrow L1 along the groove sections 37*b*, similar to the second embodiment described above. In other words, also according to the present embodiment, the groove sections 37*b* and the shafts 22*a* constitute guide portions 50 guiding the manual sheet-feeding tray 22 between the first position and the second position.

Figure 13:
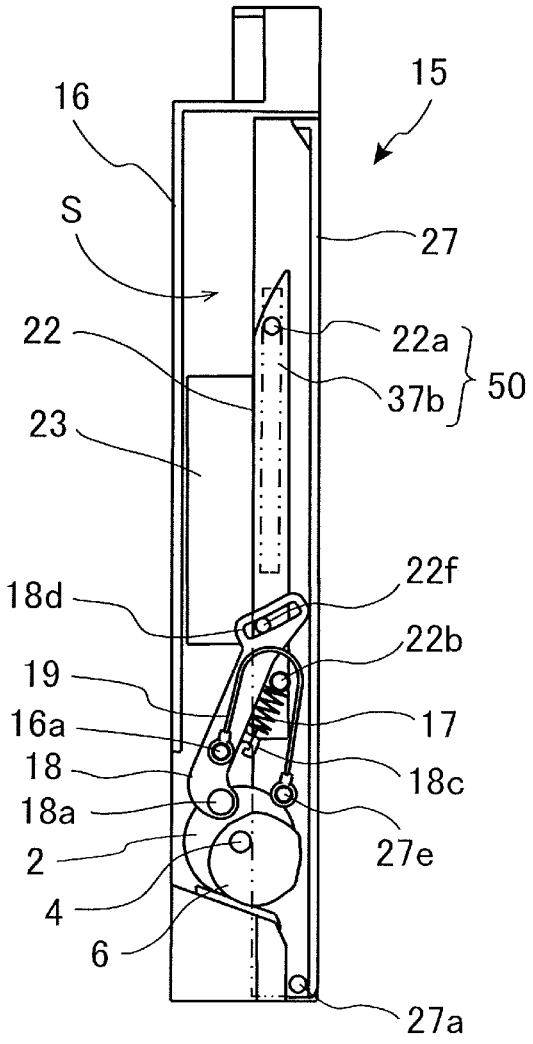
FIG. 13 is a side view showing the manual sheet-feeding apparatus in a state where the manual sheet-feeding tray is stored.

At this time, since the distance between the shafts 16*a* of the manual feed frame 16 and the shafts 27*e* of the manual feed cover 27 is widened, the retention wires 19 having been slackened as shown in FIG. 13 described later will be in a stretched state. Thereby, the manual feed cover 27 can be retained in the opened state, and the manual sheet-feeding tray 22 can be retained at the first position.

Figure 12:
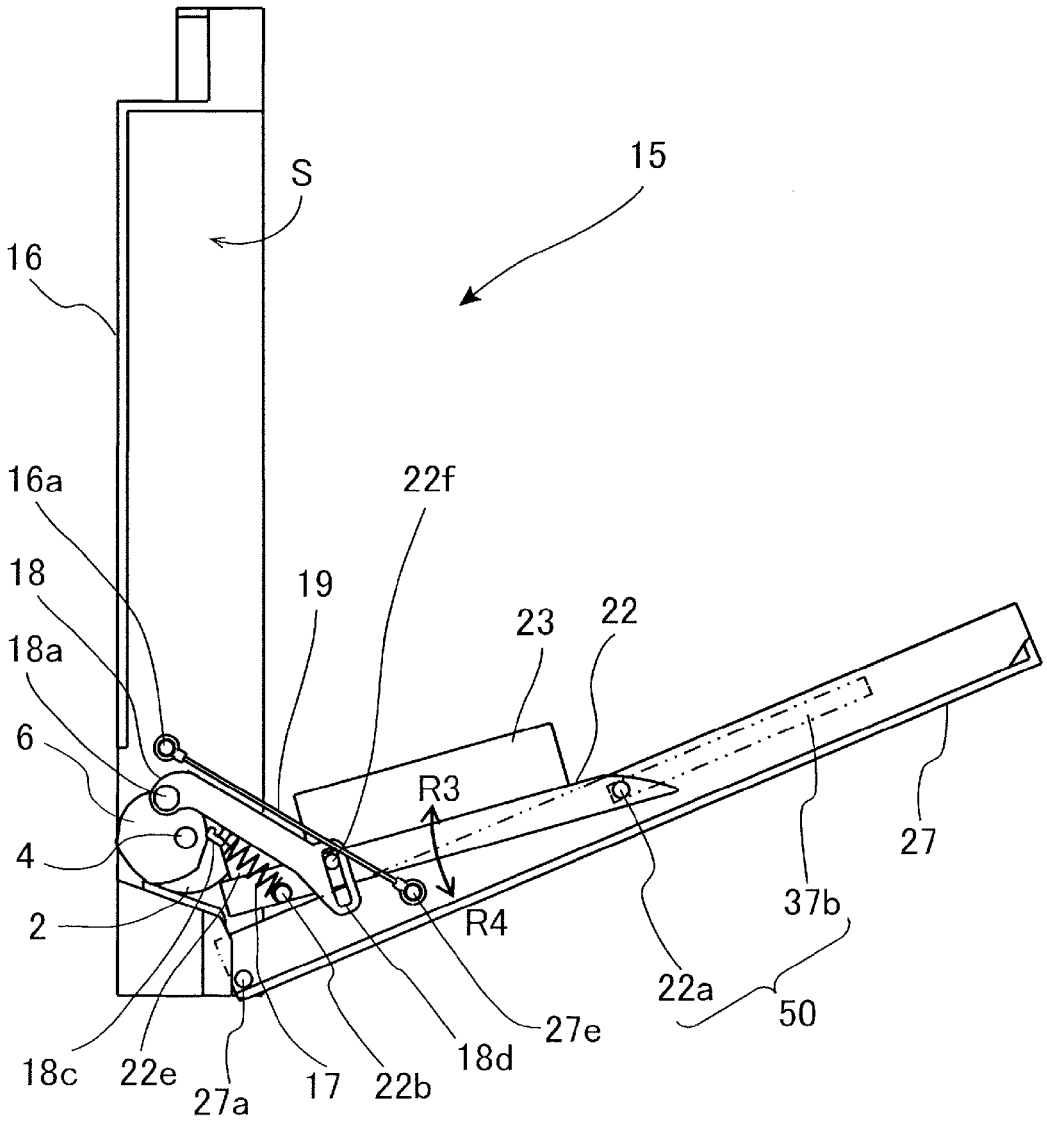
FIG. 12 is a side view showing the manual sheet-feeding apparatus in a state where a sheet is fed.

Thereafter, when the sheet feeding operation is started and the feed roller 2 is rotated, the cams 6 are separated from the contact portions 22*e* of the manual sheet-feeding tray 22 along with the rotation of the feed roller 2. Thereby, as shown in FIG. 12, the manual sheet-feeding tray 22 is rotated upward around the shaft 22*a* as fulcrum to be in contact with the feed roller 2 by the biasing force of the pressurizing spring 17. Then, when the manual sheet-feeding tray 22 is rotated upward, the uppermost sheet stacked in the manual sheet-feeding tray 22 is pressed against the feed roller 2. Thereafter, when the feed roller 2 is rotated, the uppermost sheet is separated one by one and conveyed downstream.

When the sheet feeding operation is completed, the user rotates the manual feed cover 27 in the direction of R1 shown in FIG. 10, and stores the manual sheet-feeding tray 22 in the storage portion S formed in the manual feed frame 16. At this time, since the shafts 22*f* of the manual sheet-feeding tray 22 and the slits 18*d* of the arm members are mutually engaged, the arm members 18 are rotated in the direction of arrow R5 around the shafts 18*a*. Then, along with the rotation of the arm members 18 in the direction of R5, the manual sheet-feeding tray 22 is pushed upward via the shafts 22*f* and moved toward the direction of arrow L2.

In the present embodiment, the arm members 18 are designed to have a length so that the manual sheet-feeding tray 22 is stored above the feed roller 2 when the manual feed cover 27 is closed, as shown in FIG. 13. At this time, the manual sheet-feeding tray 22 is positioned at a second position farthest from the first position. Since the arm members 18 have such length, the manual sheet-feeding tray 22 can be stored without interfering with the feed roller 2 when closing the manual feed cover 27. In the state where the manual feed cover 27 is closed, the manual feed cover 27 is overlapped with the feed roller 2 when viewed from the axial direction of the roller shaft 4. Thus, it becomes possible to downsize the laser beam printer 1. Further, since the distance between the shafts 16*a* of the manual feed frame 16 and the shafts 27*e* of the manual feed cover 27 is narrowed when the manual feed cover 27 is closed, the retention wires 19 are stored in a sagged state in the manual feed frame 16.

Now, in the state where the manual sheet-feeding tray is opened with respect to the manual feed frame 16, the arm members 18 and the retention wires 19 are arranged close to the feed roller 4 and the arm members 18 so as not to get in the way when the side regulating plates 23 and 24 are manipulated, as shown in FIG. 10. Thereby, it becomes possible to prevent components from being arranged in the space around the side regulating plates 23 and 24, and to ensure enough space to allow the hand of a user to enter when manipulating the side regulating plate 23 without increasing the width size of the printer body 1A.

As described, according to the present embodiment, similar to the second embodiment described earlier, the manual sheet-feeding tray 22 is stored in the storage position (second position) above the feed roller 2 in conjunction with the operation for closing the manual feed cover 27 when storing the manual sheet-feeding tray 22. Therefore, it becomes possible to prevent the increase in size of the printer body 1A. Since the arm members 18 and the retention wires 19 can be arranged close to the feed roller 2, the operability of the side regulating plates 23 and 24 can be improved. Further, by using the retention wires 19, it becomes possible to improve the retention strength of the manual feed cover 27 when opening the manual feed cover 27 by a simple configuration.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-219967, filed Oct. 29, 2014, which is hereby incorporated by reference herein in its entirety.

What is claimed is:

1. A sheet feeding apparatus comprising:

an apparatus body;

a cover openably/closably supported on the apparatus body;

a sheet stacking portion disposed on an apparatus body-side of the cover and stacking a sheet;

a slide member slidably supported on the cover between a first slide position and a second slide position, the slide member configured to turnably support the sheet stacking portion around a first turning fulcrum at the first slide position;

a sheet feeding portion disposed on the apparatus body and configured to feed the sheet stacked on the sheet stacking portion in a case where the slide member is positioned at the first slide position;

a regulating portion disposed on the sheet stacking portion in a manner movable in a width direction orthogonal to a sheet feeding direction and configured to regulate a position of an end portion, in the width direction, of the sheet stacked on the sheet stacking portion; and a moving portion connected to the slide member turnably around a second turning fulcrum positioned more downstream in the sheet feeding direction than the first turning fulcrum and configured to move the slide member, in conjunction with a closing operation of the cover, from the first slide position to the second slide position such that the sheet stacking portion does not interfere with the sheet feeding portion, the moving portion being disposed outside of the regulating portion in the width direction.

2. The sheet feeding apparatus according to claim 1, wherein the moving portion includes a first end side turnably supported on the apparatus body, and a second end side turnably connected to the sheet stacking portion around the second turning fulcrum.

3. The sheet feeding apparatus according to claim 2, wherein the second turning fulcrum is positioned more downstream in the sheet feeding direction than a center part of the regulating portion in the sheet feeding direction.

4. The sheet feeding apparatus according to claim 1, further comprising a positioning portion disposed on the cover and positioning the slide member at the first slide by having the slide member abutted against the positioning portion in a case where the cover is opened.

5. The sheet feeding apparatus according to claim 1, wherein an upper surface of the slide member is positioned lower than an upper surface of the sheet stacking portion.

6. The sheet feeding apparatus according to claim 1, further comprising:

an elevation unit configured to move the sheet stacking portion up and down with respect to the sheet feeding portion around the first turning fulcrum;

wherein the sheet feeding portion includes a feed roller rotatably supported on a rotation shaft; and the elevation unit includes a cam member fixed to the rotation shaft, a contact portion disposed on the sheet stacking portion and capable of being in contact with the cam member, and a biasing member biasing the sheet stacking portion toward the feed roller.

7. The sheet feeding apparatus according to claim 2, wherein the moving portion is a pair of arm members.

8. The sheet feeding apparatus according to claim 2, wherein the cover turns around an turning shaft disposed below the sheet feeding portion, and in a case where the cover is closed to the apparatus body, the cover is overlapped with the sheet feeding portion when viewed from an axial direction of the turning shaft.

9. An image forming apparatus comprising:

the sheet feeding apparatus according to claim 1; and an image forming portion forming an image on a sheet fed via the sheet feeding apparatus.

10. The sheet feeding apparatus according to claim 1, wherein in a case where the cover is closed with respect to the apparatus body and the slide member is positioned at the second slide position, the sheet stacking portion is overlapped with the sheet feeding portion in a plan view and is not overlapped with the sheet feeding portion when viewed from a normal direction of an outer surface of the cover.

* * * * *